United States Patent [19]

Younes

[11] Patent Number: 4,472,083

[45] Date of Patent: Sep. 18, 1984

[54] OIL WELL RIG WITH WATER TOWER

[76] Inventor: David T. Younes, P.O. Box 7333, Abu Dhabi, United Arab Emirates

[21] Appl. No.: 450,909

[22] Filed: Dec. 20, 1982

[51] Int. Cl.[3] ..... B66F 3/02; E02B 17/00; E02B 17/08

[52] U.S. Cl. ..... 405/196; 405/195; 405/198; 114/265; 254/95

[58] Field of Search ..... 405/195–198, 405/203, 204, 210; 166/335, 362; 114/264, 265; 137/236 S; 254/89 R, 95, 97

[56] References Cited

U.S. PATENT DOCUMENTS

| | | | |
|---|---|---|---|
| 2,308,743 | 1/1943 | Bulkley et al. | 405/198 |
| 3,872,679 | 3/1975 | Fischer | 114/265 |
| 3,967,457 | 7/1976 | Lovie | 405/198 |
| 4,116,009 | 9/1978 | Daubin | 114/264 |
| 4,350,014 | 9/1982 | Sanchez et al. | 114/264 X |

FOREIGN PATENT DOCUMENTS

| | | | |
|---|---|---|---|
| 2441019 | 7/1980 | France | 405/198 |

*Primary Examiner*—Cornelius J. Husar
*Assistant Examiner*—Nancy J. Stodola
*Attorney, Agent, or Firm*—Arthur G. Yeager

[57] ABSTRACT

An oil well rig having a flotatable hull and support legs which are lifted and supported by the floating hull for moving the oil well rig and moved down to engage the sea bottom and jack up or raise the hull above the water at an operating site for drilling or servicing a well or serving an offshore well platform. A water tower has pipes longitudinally mounted by brackets on each side on a beam and is mounted for vertical movement in a well in the hull. An elevator mechanism mounted in the hull is employed to raise and lower the water tower which has guide means fitting a guide portion of the well to provide guided vertical movement of the water tower. When the water tower is lowered, a pump at the bottom of the pipe pumps sea water through the pipe to machinery on the hull to meet the water requirements of the machinery.

11 Claims, 6 Drawing Figures

OIL WELL RIG WITH WATER TOWER

FIELD OF INVENTION

This invention relates to offshore oil well rigs, such as oil well platforms or oil well servicing ships having a flotatable hull, support legs providing jack up capability and an improved water supply assembly having a water tower vertically movable down through a well in the hull to pump water from the sea for supplying water requirements for operating the oil well rig when the rig is jacked up.

DESCRIPTION OF THE PRIOR ART

In offshore oil well rigs, rack and pinion drives have been used to move support legs relative to the flotatable hull as shown in U.S. Pat. Nos. 2,308,743 and 3,967,457. Water tower arrangements having a plurality of pipes, a triangular truss or lattice type tower and a rack and pinion elevating system are used.

SUMMARY OF THE PRESENT INVENTION

This invention provides a unique raw and sea water supply assembly for offshore oil well rigs having a flotatable hull and support legs providing jack up capability. The water supply assembly has a water tower mounted for vertical movement in a well secured and sealed in the hull. The water tower is stored on the deck of the hull or vertically raised up in the well so it cannot contact the sea bottom when the hull is floating for moving the oil well rig. When the oil well rig is at an operating site, the support legs are lowered relative to the hull to engage the sea bottom and raise or jack up the hull above the water level. Also, the water tower is lowered through the well until the lower end of the pipe is below sea level in still water.

The water tower is an elongated rigid structure having a pipe, beam means, guide means and a rack and is guided for vertical sliding movement by its movable guide means engaging stationary guide means in the well constructed in the hull. Elevator means employs a pinion engaging the rack and driven by a motor or braked by a brake to raise, lower or hold the water tower. Preferably the water tower has a pair of similar movable guide means and a pair of racks with one guide means and one rack located on one side and the other guide means and other rack located directly opposite on the other side of the water tower. The elevator means has a pair of elevator mechanisms mounted on opposite sides of the well and each having a pinion engaging a rack to balance the gear forces. A motor and brake is drive connected to each pinion for raising, lowering and holding the water tower. The motors or brakes are normally operated jointly but each has the capacity for independent emergency operation on failure of the other.

The well extends vertically through the hull and has the top portion supported by the main deck located above the water line and the bottom secured and sealed to the bottom shell. When the oil well rig reaches an operating site and is jacked up, the water tower is lowered through the well to the pumping position so the lower inlet end of the pipe is in normally still water. A pump mounted on the pipe pumps raw or sea water through the pipe and a supply connector, such as a hose, to supply water requirements to storage or directly for the machinery on the oil well rig, e.g. cooling engines and drilling.

The water tower in the preferred arrangement has a centrally located long support member and a pair of pipes and a pair of racks both mounted on and extending longitudinally alongside the support member. The support member in the preferred form is an I-beam with the pipes mounted on the opposite sides of the web and the racks mounted on the opposite transverse faces of the flanges. Each pipe extends along one side of the web between the flanges and is secured to the I-beam by a plurality of spaced brackets each having a pair of spaced saddle plates. Each plate is secured to one side of the web and between the flanges of the I-beam, extends transversely and has a circular recessed support portion engaging and secured to the pipe on that one side to mount the pipe on the I-beam. Stiffener panels of rectangular shape fit between adjacent pairs of saddle plates, the web of the I-beam and the pipe and are secured thereto to stiffen the water tower assembly. The I-beam has a plurality of central openings in the web. The stiffener panels have recesses at the edge engaging the web aligned with an opening in the web between the saddle plates to reduce the water current, wave and wind forces acting on the water tower in all directions. The water tower has an eliptic shape in cross section with the pipes located on opposite web sides of the I-beam on the long axis and the racks on the flange faces on the transversely extending short axis.

The I-beam has a height slightly larger than the diameter of the pipe. The pipe flanges are spaced from I-beam so they may be connected to other flanges for connectors, pumps, etc. The well in the hull has an elliptic shape in cross section and a guide recess at each end of the short axis extending the full vertical length of the well. The water tower has an elliptic cross section that fits into the well and the flange and rack at each end of the short axis provide movable guide means fitting into the guide recess at each end of the short axis of the well which provide stationary guide means to guide the water tower for vertical movement in the well. Thus water tower and wall have small deck area requirements and high strength relative to transverse forces.

The rack is about half as wide as the flange and is centrally secured to the flange. Each flange has flat guide surfaces on the face at each side of the rack and at the side edges. The guide recess has a guide recess portion fitting the flange on on each side of the rack and each edge with clearance and a central rack recess portion fitting the rack on each side and the tooth face with clearance to guide the water tower for vertical movement.

BRIEF DESCRIPTION OF THE DRAWINGS

The novel features which are believed to be characteristics of this invention are set forth with particularity in the appended claims. The invention itself, however, both as to its organization and method of operation, together with further objects and advantages thereof, may best be understood by reference to the following description taken in connection with the accompanying drawings, in which:

FIG. 5 is a partial plan view with parts broken away and in section of the water tower; and FIG. 6 is a partial sectional view taken on the line 6—6 of FIG. 5.

DETAILED DESCRIPTION OF THE INVENTION

Figure 1:
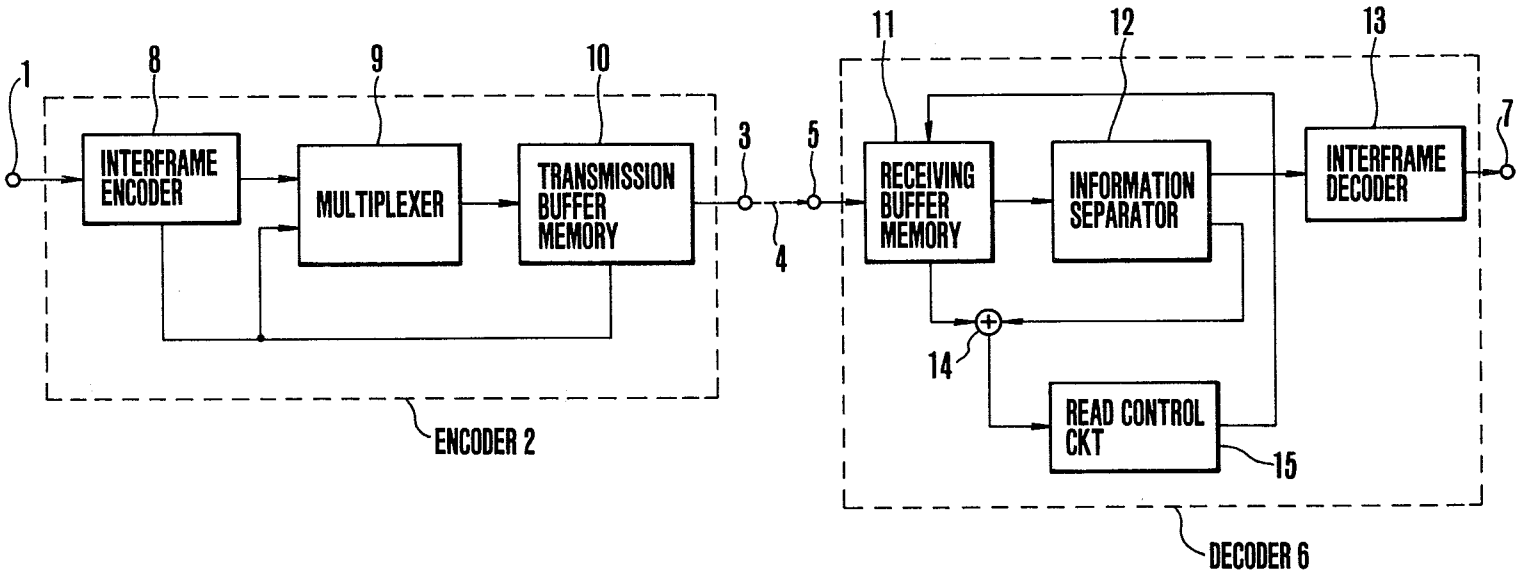
FIG. 1 PRIOR ART
FIG. 1 is a partial side diagrammatic elevation of an oil well rig having a raw water supply assembly.

Referring to the drawings, especially FIG. 1, the known offshore oil well rig 10, such as an oil well drilling or servicing platform or ship, has a flotatable hull 11 and three or more support legs 12, one being shown diagrammatically, having jack up means 13 providing jack up capability. The legs 12 are supported by hull 11 and raised relative to hull 11 so legs 12 do not engage the sea bottom so the hull floats during movement of rig 10 to a location or operating site. At the site legs 12 are lowered relative to hull 11 by jack up means 13 to engage the sea bottom and jack up hull 11 to the operating position above the water level shown in FIG. 1. The water supply assembly 14 has a water tower 15 mounted for vertical guided movement in a well 16 constructed in hull 11. A pair of power elevator mechanisms 17, 17′ provide the power elevator means which raises, lowers and holds water tower 15. During movement of rig 10, the water tower 15 is raised so the lower end is above the bottom of legs 12 or higher to reduce the resistance to movement of hull 11 and stress on water tower 15.

Figure 2:
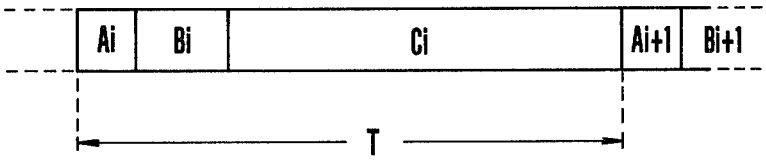
FIG.2 PRIOR ART
FIG. 2 is a partial enlarged sectional view with parts broken away and in section on the line 2—2 of FIG. 1 showing the details of the water tower and well.

The water tower 15 has a long support member, preferably an I-beam 18, a pair of pipes 19, 19′ mounted on the opposite wide sides of support member 18 and a pair of racks 20, 20′, FIG. 2, mounted on the opposite narrow sides of support member 18. As shown in FIG. 2 water tower 15 has an elliptical cross section which is symmetric or similar about both the long horizontal axis and the short vertical axis, so for convenience similar parts on the other or opposite side of these axes may have the same reference numbers primed. The I-beam 18, two pipes 19, 19′ and two racks 20, 20′ extend longitudinally parallel to each other. I-beam 18 has a web 21 providing the wide sides of the support member and flanges 22, 22′ at opposite ends of web 21 provide the narrow sides. Each of flanges 22, 22′ providing the narrow side of the support means and flat end faces 24, 25 and 24′, 25′ on opposite ends of each flange 22, 22′ at a right angle to outer face 23, 23′. Each rack 20, 20′ is secured, e.g. by welding, centrally respectively to the outer face 23, 23′ of each flange 22, 22′ of I-beam 18 to provide a pair of racks 20, 20′ on the opposite narrow or flange sides of I-beam 18. The flat outer faces 23, 23′ on each side of racks 20, 20′, flat end faces 24, 25 and 24′, 25′ and racks 20, 20′ on flanges 22, 22′ respectively provide movable guide means 52, 52′ on opposite flange sides of I-beam 18 on water tower 15. The I-beam 18, pipes 19, 19′ and racks 20, 20′ are fabricated by welding together suitable standard lengths, e.g. 20 foot lengths, of such members. The I-beam section has a height or web length about twice the diameter of the maximum diameter pipe used and a flange width about one fourth the height. Water towers having a height of 60, 80 and 100 feet and having pipe of respectively 6, 8 and 10 inch diameter provide the desired structural strength and stiffness.

The pipes 19 and 19′ are mounted respectively by mounting assemblies 26 and 26′, FIGS. 5 and 6, on opposite wide sides of I-beam 18. The mounting assembly 26 has a upper, a middle and lower mounting bracket 27, 28 and 29. Each of these mounting brackets has a spaced pair of saddle plates 30 extending transversely from I-beam 18 to pipe 19. Each saddle plate 30, FIG. 2, has a base 31 fitting against one side perpendicular to web 21 and extending across web 21 so the ends 32 fit between the flanges 22, 22′ on the same side of web 21 and are secured, e.g. by welding, to this one side of web 21 and the adjacent inside faces of flanges 22, 22′. The saddle plates 30 also have a semicircular recess 33 fitting half of pipe 19 at the outer side opposite base 31 and secured thereto, e.g. by welding. The ends 32, have a tapered portion 34 between flanges 22, 22′ tapering toward the end of the semicircular recess 33. Each mounting bracket 27, 28, 29 has between its pair of saddle plates 30 a longitudinally extending rectangular stiffener plate 35 mounted between and perpendicularly secured, e.g. by welding, at the ends 36 welded transversely to the adjacent saddle plates 30 and at the longitudinal sides 37 welded longitudinally to the adjacent side of web 21 and to the pipe 19 closest to web 21. In the mounting assembly 26, a strap 38 and a strap 39 are secured, e.g. by welding, to each saddle plate 30 centrally of tapered portion 34 of the opposite ends 32. The strap 38 has a top brace portion 40 above the top saddle plate 30 of upper bracket 26 merging to pipe 19 and secured thereto. The strap 38 also has a bottom brace portion 41 below the lower saddle plate 30 of lower bracket 29 merging to pipe 19 and secured thereto. The strap 39 has similar top and bottom braces not shown. In order to reduce the wind and water forces on water tower 15, the web 21 has elliptical openings 44 between the mounting brackets 27, 28 and 29 and round openings 45 between the pair of saddle plates 30 of each mounting bracket. The stiffener plates 35 also have elliptical recesses 53 in the sides 37 secured to web 21 which are transversely aligned with the round openings 45 so wind and water may pass in all directions through the web 21 and stiffener plates 35 whence they form a dike and right angle. The web 21 has at the top end a hook eye 46, FIG. 6, to receive a derrick hook for placing water tower 15 in well 16.

The water tower 15 has a mounting assembly 26′ which is a mirror image of the above described mounting assembly 26. The mounting assembly 26′ mounts the pipe 19′ on the opposite side of web 21 of I-beam 18 so like reference numerals primed have been used and reference is made to the above description. The water tower 15 has high strength relative to forces along the transverse short axis due to the alignment of web 21 of I-beam 18 and has high strength relative to forces along the transverse long axis due to pipes 19, 19′ being mounted by saddle plates 30, 30′ in spaced relation to the web sides of I-beam 18.

The pipes 19, 19′ respectively have bottom flanges 47, 47′ FIGS. 1 and 5 on which pumps P1 and P2 are mounted and top flanges 48, 48′ on which connectors 49, 49′, e.g. pipes for hoses are mounted to supply water to storage tanks and/or machinery 50, 50′ for cooling or operating water requirements. The I-beam 18 has a projecting portion 51 extending below the pipes 19, 19′ and pumps P1, P2 to protect the pumps from engaging the sea bottom and sucking sand.

Figure 3:
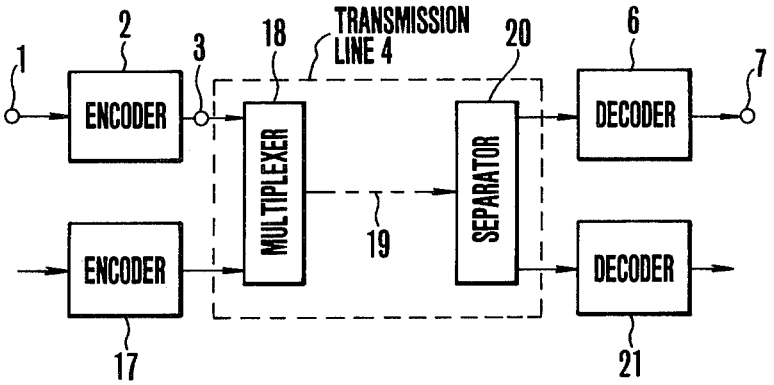
FIG.3 PRIOR ART
FIG. 3 is a partial side elevation view with parts broken away and in section taken on the line 3—3 of FIG. 2.
Figure 4:
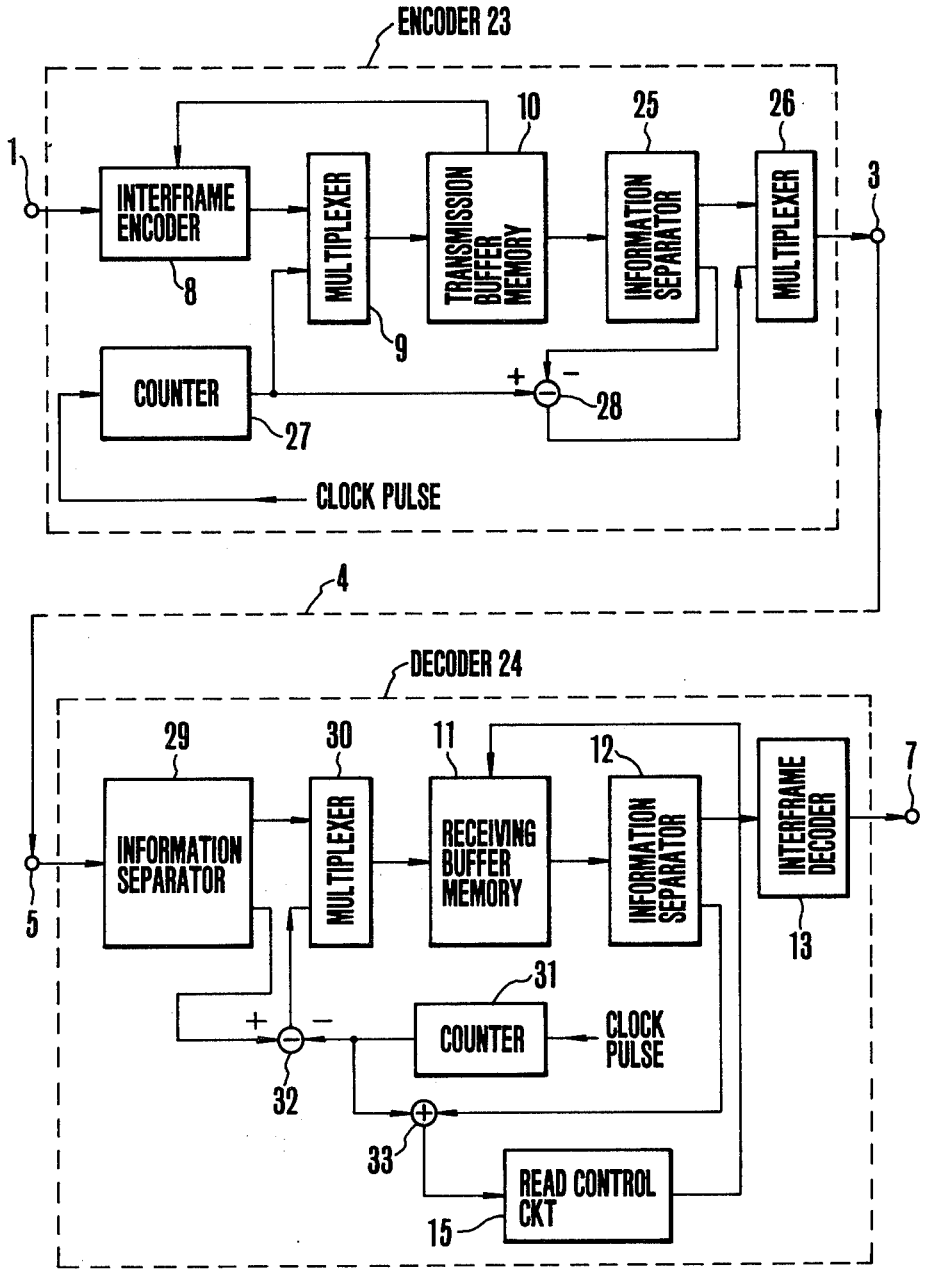
FIG. 4 is a partial sectional view with parts broken away and in section taken on the line 4—4 of FIG. 2.

The general arrangement of the water supply assembly is shown in FIG. 1 and the details for slidably mounting water tower 15 in well 16 are shown in FIGS. 2, 3 and 4. The well 16 has an elliptic section and extends vertically through hull 11, through the bottom shell 55 to which it is sealed, through the main deck 56 and above main deck 56 a short distance to accommodate the elevator mechanisms 17, 17'. In section, elliptical well 16, has stationary guide portions 57, 57' at opposite ends of the short axis and semi-elliptical end members 58, 58' on opposite sides of guide portion 57, 57' along the long axis. These parts of the well are secured and sealed, e.g. by welding, to each other and to bottom shell 55 of hull 11 and secured to main deck 56. The stationary guide portion 57 has a pair of angle members 59, 60 each respectively having a transverse leg 61, 62 welded to the adjacent vertical edge of end members 58, 58' and a longitudinal leg 63, 64. The interior of transverse legs 61, 62 respectively slidably engage the flat end faces 24, 25 of flange 22 and the longitudinal legs 63, 64 slidably engage the flat outer face 23 of flange 22 on opposite sides of rack 20 with sufficient clearance for free sliding movement of water tower 15.

The guide portion 57 also has a first side plate 65 secured and sealed, e.g. by welding, along the full length of its inner vertical edge or the height of well 16 to the end of leg 63 of angle iron 59. The elevator mechanism 17 has a drive shaft 66 rotatably mounted in a bearing 67 fastened by fasteners, e.g. screws 68, to first side plate 65. Shaft 66 extends through a hole 69 in first side plate 65 and is drivingly connected to pinion gear 70 which meshes with rack 20. A brake 71 is secured by mounting on well 16 by bracket 72 to first side plate 65 and end member 58 and operative to brake and hold pinion gear 70, rack 20 and water tower 15. The motor 73, which may be hydraulic or electric, is supported by brake 71 and mounting bracket 72 on well 16 and operative to rotate the drive shaft 66, pinion gear 70 and rack 20 in either direction to raise or lower water tower 15.

A second side plate 74 has a short upper portion 75 and a long lower portion 76 extending from below pinion gear 70 and a little above main deck 56 to bottom shell 55. These upper and lower portions 75, 76 are spaced over pinion gear 70 to provide access opening 77 FIG. 3 for insertion and removal of pinion gear 70. A rack cover plate 78 is secured and sealed, e.g. by welding, between the first and second side plates 65, 74 and has a long lower portion 79 extending the same length as lower portion 76 of second side plate 74 from above main deck 56 to bottom shell 55 to make well 16 water tight and a short upper portion 80 having the same length as upper portion 75 to guide rack 20 for meshing with pinion gear 70. A retainer plate 81 bridges opening 77 and has a stiffener 82 perpendicular thereto and a spacer 83 engaging pinion gear 70 to retain pinion gear 70 in alignment for meshing with rack 20 when retainer plate 81 is held by fasteners, e.g. screws 84, at the top and bottom to second side plate 74. Bridging plates 85, 86, 87 are secured, e.g. by welding, and extend transversely between first and second side plates 65, 74 from rack cover plate 78 respectively at the top and bottom of upper portion 80 and top of lower portion 79. Upper front cover 88 is secured, e.g. by welding, to the outer edges of first and second side plates 65, 74 and bridging plates 85, 86. Lower front cover 89 is welded to first and second side plates and bridging plate 87 and extends down to the main deck 56.

The guide portion 57' of well 16 is a mirror image of the above described guide portion 57 and is located at the opposite side or end of the short axis of elliptical well 16, as shown in FIGS. 2 and 4. Since both guide portions 57, 57' are shown in the drawing and the same reference numerals primed have been used for such portion, the entire structure will be clear when reference is made to the above description of guide portion 57. In these guide portions 57, 57' the first and second side plates 65, 74, 65', 74' are wide to stiffen and strengthen these flat parts of the well 16 at the ends of the short axis. Grease fittings 90, 90' respectively extend through upper front cover plate 88, 88' and the upper portion 80, 80' of rack cover plate 78, 78' to grease racks 20, 20' and the guide portions.

The oil well rig 10 is moved to an operating site like a platform, a barge or a ship. The water tower 15 may be stored on the main deck 56 of hull 11 or mounted in well 16 of hull 11 with brakes 71, 71' set to hold pinion gears 70, 70' and water tower 15 in a fixed height position in hull 11. When the oil well rig 10 is being moved, both water tower 15 and legs 12 must be sufficiently high so they do not engage the sea bottom. When the oil well rig 10 reaches an operating site, legs 12 are operated to jack up the oil well rig 10 to a proper operating height FIG. 1. The water tower 15 is now or was previously placed in well 16 by a derrick. When water tower 15 is in well 16, the flanges 22, 22' and racks 20, 20' provide movable guide means 52, 52' respectively mounted in stationary guide portions 57, 57' with a sliding clearance to provide guide means to guide water tower 15 for vertical sliding movement in well 16. The following portions of water tower 15 fit between parts of guide portions 57, 57' of well 16 with clearance for free sliding movement and engage for guided vertical movement. Flange 22 has end faces 24, 25 disposed between and engaging transverse legs 61, 62 and rack 20 has sides disposed between and engaging first and second side plates 65, 74 to prevent tilting of water tower 15 about the short axis. Flange 22' and rack 20' function similarly. The flanges 22 and 22' each have an outer face 23 and 23' engaging respectively longitudinal legs 63, 64 and 63', 64' at opposite sides of the long axis to prevent tilting about the long axis. The racks 20 and 20' also respectively engage rack cover plates 79 and 79' on opposite sides of the long axis to prevent tilting of the water tower about a long axis. Since the guide portions 57, 57' extend a long distance from main deck 56 to bottom shell 55 a low friction guide means is provided.

The elevator means, elevator mechanisms 17, 17' has racks 20, 20' on opposite sides of I-beam 18, pinion gears 70, 70' meshing with racks 20, 20', a motor 73, 73' for driving each pinion gear 70, 70' to raise water tower 15 and a brake 71, 71' for braking and holding each gear 70, 70' to hold water tower 15 in a fixed position. The controls normally operate both motors 73, 73' and release both brakes 71, 71' to raise water tower 15. To lower water tower 15 the brakes 71, 71' are partially released. Each of the motors 73, 73' have sufficient capacity to raise water tower 15 and each brake 71, 71' has sufficient capacity to hold water tower 15 so in the event of a failure of one motor or one brake or one drive connection the other motor, brake or connection can hold the water tower for safety and while repairs are being made.

The water tower 15 with the pipes having flanges 47, 47' and 48, 48' being mounted on the long side of I-beam 18 and racks 20, 20' being mounted on the outer faces 23, 23' of flanges 22,22' have a generally elliptical cross section shape fitting with generous clearance in the well 16 having a similar elliptic cross section so there is sliding contact only at the guide means.

While the invention has been described with respect to a certain specific embodiment, it will be appreciated that many modifications and changes may be made by those skill in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an offshore oil well rig, a flotatable hull having a main deck above the water line and a bottom shell, a plurality of supporting legs mounted on said hull having jack up means for lowering said support legs relative to the hull for engaging the sea bottom and for lifting said hull to a raised position above the water and for raising said support legs relative to said hull to lower said hull for flotation on the water and lift said support legs above the sea bottom, a sea water supply assembly mounted on said hull having a water tight well extending vertically through and supported on said main deck and bottom shell of said hull and sealed to said bottom shell and a water tower mounted in and extending vertically through said well, said water tower having beam means, pipe means and rack means secured together along their length and each extending longitudinally to provide a tall unitary water tower structure, mechinery having water requirements on said hull, water connector means connected to the top of said pipe means for supplying water to said machinery, pump means mounted on said pipe means to pump water from the sea up through said pipe means to said water connector means, guide means on said water tower and said well for guiding said water tower for straight line vertical movement through said well and elevator means mounted on said well and operatively connected to said rack means of said water tower means to raise, lower or hold said water tower means in selected upper positions for moving said oil well rig and selected lower positions with the lower end of said pipe means in still water below the water level when said hull is in raised position for employing said pumping means for pumping water.

2. The invention defined in claim 1 wherein said beam means is defined by one I-beam having a long web and short flanges at each end of said web, said pipe means includes a pipe extending longitudinally along the web side of said I-beam, mounting means for securing said pipe to said I-beam adjacent said web having a plurality of mounting brackets spaced along said I-beam, each mounting bracket having a pair of saddle plates, each saddle plate having a base extending transversely across said I-beam and fitting against said web and between said flanges on one side of said web and welded to said web and flanges, and each said saddle plate further extending transversely and having a recess at the outer side fitting said pipe and welded to said pipe to secure said pipe in spaced relation to said I-beam.

3. The invention defined in claim 1 wherein said pipe means includes a flange at the top and bottom ends and said pump means is mounted on said flange at the bottom end of said pipe and said beam means extends below said pipe and pump means to prevent said pump means engaging the sea bottom.

4. The invention defined in claim 1 wherein said water tower includes a central I-beam having a long web and short flanges at opposite ends of said web, a pipe mounted on each side of said web, a rack mounted on the outer face of each flange, said guide means includes movable guide means on said water tower being defined by each of said flanges and said racks, and stationary guide means on said well being defined by a recess engaging the teeth and sides of each rack and a recess engaging the face and sides of each flange.

5. The invention defined in claim 1 wherein said beam means of said water tower is defined by one I-beam having a web and a flange at each opposite end of said web, said flanges each having an outer face and opposite side faces, said rack means being a pair of racks with each of said racks being secured centrally to one of said outer faces, said rack each having an outer toothed face and opposite side faces, said guide means on said water tower being defined by said outer face on both sides of the rack secured thereto and said opposite side faces of each of said flanges and said outer face and opposite side faces of each of said racks, and opposed guide means on each side of said well having a wide recess engaging said outer face of said opposite flanges on each side of said rack and said opposite side faces of each said flanges, and a narrow recess in the bottom of each of said wide recesses engaging the outer face and sides of each rack to guide said water tower for vertical movement in said well.

6. The invention defined in claim 5 wherein said elevator means includes a pair of pinions, each pinion engaging one of said racks, an independently operable motor connected to each of said pinions, an independently operable brake connected to each of said pinions, each motor has sufficient capacity to raise said water tower, each brake has sufficient capacity to hold said water tower, and control means operable to normally actuate both motors for raising and both brakes for holding said water tower and operable on failure of one motor and one brake to isolate the one failed motor and brake and continue operation of the other motor and brake for emergency operation of said elevator means.

7. The invention defined in claim 1 wherein said beam means is defined by one I-beam having a long web and short flanges oppositely disposed at each end of said web, said pipe means being two pipes, one pipe being mounted on each side of said web and extending longitudinally between said flanges, said rack means being two racks, one rack being longitudinally attached to the outer face of each of said flanges providing opposed rack and flange assemblies, said guide means on said water tower being the outer and side surfaces on said opposed rack and flange assemblies, said guide means on said well being a pair of oppositely disposed longitudinal recesses facing each other and having inner and side surfaces slidably engaging said rack and flange assemblies.

8. The invention defined in claim 7 further comprising mounting means for mounting said pipes on said I-beam having upper, middle and lower mounting brackets mounting each of said pipes on said I-beam, each mounting bracket including a spaced pair of saddle plates each having a base side, ends and outer recessed side respectively transversely fitting, engaging and secured to said web, flange portions and said pipe and extending perpendicular to said web, a rectangular stiffener plate having sides and ends centrally and perpendicularly engaging and secured respectively between and to said web and pipe and said spaced pair of saddle plates, a bracing strap secured to each end of each saddle plate of each mounting bracket having sloping end portions secured to one of said pipes to brace said saddle plates in perpendicular position.

9. The invention defined by claim 8 wherein said I-beam web has a plurality of large central openings between said mounting brackets and between the pair of saddle plates of said mounting brackets, the openings extend on both sides of the stiffener plates, a recess is provided in the side of the stiffener plates secured to the web at the openings to permit flow of water and air in all directions transversely through the water tower to reduce stress.

10. The invention defined in claim 9 wherein said elevator means has dual units mounted on said well and each having a shaft, a pinion mounted on said shaft meshing with one of said racks, a motor for driving said shaft, a brake for holding said shaft and control means for normally selectively operating both motors and brakes to raise, lower and hold said water tower, said motors and brakes each having sufficient capacity to raise and hold said water tower and said controls providing for emergency operation by one motor and one brake after failure of the other.

11. The invention defined in claim 10 wherein said well has a guide portion at each end of the short axis of said well adjacent said opposite flanges, each of said guide portions having an angle iron fitting the opposite outer corners of one flange, a side plate at each side of one of said racks secured to the inner leg of the adjacent angle iron and extending outwardly and a rack cover plate secured between said side plates covering said one rack and securing each guide portion together, said shaft of said elevator means being pivotally mounted on a side plate, said side plates being wide to longitudinally stiffen said guide portion and end portions of semi-elliptical shape having each end edges secured to the inwardly facing legs of a pair of angle irons at opposite ends of said web of said I-beam and on the same side of said web to provide the long axis portion of said elliptic well.

* * * * *